US005182999A

United States Patent [19]

Dietl

[11] Patent Number: 5,182,999

[45] Date of Patent: Feb. 2, 1993

[54] SEWING MACHINE FEEDER DRIVE AND STITCH-LENGTH ADJUSTMENT MECHANISM

[75] Inventor: Rudolf Dietl, Munich, Fed. Rep. of Germany

[73] Assignee: J. Strobel & Sohne GmbH & Co., Munich, Fed. Rep. of Germany

[21] Appl. No.: 775,904

[22] Filed: Oct. 15, 1991

[30] Foreign Application Priority Data

Oct. 16, 1990 [DE] Fed. Rep. of Germany ..... 4032813

[51] Int. Cl.[5] ..... D05B 1/24

[52] U.S. Cl. ..... 112/178

[58] Field of Search ..... 112/176, 178, 315, 314, 112/177, 319, 322

[56] References Cited

U.S. PATENT DOCUMENTS

| | | | |
|---|---|---|---|
| 4,328,759 | 5/1982 | Astrupgaard et al. . | |
| 4,391,216 | 6/1983 | Hsiao . | |
| 4,444,142 | 4/1984 | Meier | 112/315 |
| 4,476,795 | 10/1984 | Vollmar . | |
| 4,495,877 | 1/1985 | Willenbacher | 112/315 X |
| 4,624,202 | 11/1986 | Alberti et al. . | |
| 4,706,584 | 11/1987 | Senda et al. | 112/315 X |

FOREIGN PATENT DOCUMENTS

| | | |
|---|---|---|
| 2625152 | 12/1977 | Fed. Rep. of Germany . |
| 2916642 | 11/1980 | Fed. Rep. of Germany . |
| 3118964 | 12/1982 | Fed. Rep. of Germany . |
| 3150141 | 8/1983 | Fed. Rep. of Germany . |
| 3321215 | 12/1984 | Fed. Rep. of Germany . |
| 3324715 | 1/1985 | Fed. Rep. of Germany . |
| 3342391 | 3/1985 | Fed. Rep. of Germany . |
| 3346163 | 4/1985 | Fed. Rep. of Germany . |

*Primary Examiner*—Andrew M. Falik
*Assistant Examiner*—Paul C. Lewis
*Attorney, Agent, or Firm*—Bacon & Thomas

[57] ABSTRACT

The invention concerns a sewing machine having a sewing-material feeder to advance the material being sewn in a step-wise manner and having furthermore a drive shaft pivoting to-and-fro in order to intermittently move the sewing-material feeder in the direction of advance of the material being sewn. The drive shaft includes a radially projecting drive crank connected by a linkbar of corresponding length to an output crank pivotably supported on a sleeve to pivot about an axis parallel to the drive shaft. The sleeve is rotatably supported on an output shaft cooperating with the sewing-material feeder and can be rotated by means of a stitch-length adjustment device. The output shaft is also parallel to the drive shaft and is driven by the output crank through a transmission provided on the sleeve. By this arrangement, a high compactness and a very advantageous force transmission between drive and output shafts can be achieved.

14 Claims, 5 Drawing Sheets

SEWING MACHINE FEEDER DRIVE AND STITCH-LENGTH ADJUSTMENT MECHANISM

BACKGROUND OF THE INVENTION

Sewing machines having a sewing area, a feeder assembly to advance material being sewn through the sewing area in a stepwise manner and a drive crank pivotable to-and-fro to move the feeder assembly intermittently in the direction in which the material being sewn is advanced are known in the art. In such arrangements, the drive crank is pivotably supported at one end and is pivoted to-and-fro by a rod connected to another end of the drive crank and driven by a cam of a drive shaft. An output crank projects radially from an output shaft to which it is affixed, and the two ends of a linkbar are connected to the other end of the drive crank and to the free end of the output crank, respectively. The output shaft comprises a radial arm having a free end linked to one end of a support beam bearing the feeder assembly for the material being sewn. At its other end, the support beam cooperates with a second cam revolving synchronously with the first cam for the purpose of intermittently raising the feeder assembly in time with its intermittent motion in the advance direction of the material being sewn.

In these known sewing machines, to adjust the length of each movement of the feeder assembly in the direction in which the material being sewn is advanced and to adjust thereby the stitch-length of the sewing machine, the pivot axis of the drive crank is displaced. When this pivot axis is aligned with the axis about which the linkbar and the output crank are mutually pivotable and when the drive shaft is running, the drive crank and the linkbar will pivot about the same axis and the linkbar will not displace the output crank whereby the output shaft is at rest. This corresponds to a stitch-length of zero. As the pivot axis of the drive crank is displaced from this position away from the drive shaft toward the output shaft forming the pivot axis of the output crank, the stitch-length is increased. The pivot axis of the drive crank is displaced by means of a stitch-length adjustment device comprising an adjustment shaft extending parallel to the drive shaft and to the output shaft and fitted with a radial arm supporting a bolt which forms the pivot axis of the drive crank. This pivot axis extends parallel to the adjustment shaft.

A known stitch-length adjustment device comprises a manually rotatable adjustment cam cooperating with the adjustment shaft by means of a rod linkage. For purposes of seam locking, the rod linkage can be actuated by a manually pivotable lever independently of the adjustment cam to rotate the adjustment shaft against a spring-loading so that the pivot axis of the drive crank moves through the zero stitch-length position away from the output shaft, as a result of which the feeder assembly when raised always moves opposite the normal direction of advance of the material being sewn. It is also possible to drive in this manner upper and lower auxiliary feeder assemblies each provided with an adjustment shaft coupled by a rod linkage to the adjustment shaft of the main feeder assembly. These two rod linkages are adjustable to assure a specific differential advancement of the material being sewn (German Offenlegungsschrift 26 25 152).

Another known stitch-length adjustment device comprises a double-acting compressed-air cylinder to actuate the adjustment shaft in either direction, the cylinder performing equal strokes in both directions which are adjustable in accordance with the particular desired stitch-length by manually rotating an adjustment sleeve on the cylinder housing. The piston rod of the compressed-air cylinder is linked to a radial arm of the adjustment shaft (German patent 29 16 642).

Further, a stitch-length adjustment device is known which comprises a digitally operating compressed-air cylinder driving the adjustment shaft and a control system for the compressed-air cylinder connected to an operating panel for setting a desired stitch length in the control system. Lower and possibly upper auxiliary feeder assemblies, may be provided to allow a differential advancing of the material being sewn, the lower auxiliary feeder assembly or both auxiliary feeder assemblies and the main feeder assembly being driven identically. An additional adjustment shaft for the single or both auxiliary feeder assemblies is provided which also is adjusted by a digitally operating compressed-air cylinder controlled in the same manner and acting on a radial arm of the adjustment shaft. In this design, a purely mechanical stitch-length adjustment device instead of an electro-pneumatic stitch-length adjustment device may be provided for the main feeder assembly (German Offenlegungsschrift 31 18 964).

It is also known with respect to sewing machines of the type indicated to take special steps to achieve specific functions, namely to sew a seam accurately to a predetermined location (German patent 31 50 141; German Offenlegungsschrift 33 24 715 and German patent 33 42 391) or to stitch together two same-pattern cloth layers so as to match the patterns (German patent 33 46 163). An electric stepping motor may be used therein (German Offenlegungsschrift 33 24 715) even for rotating the adjustment cam (German patent 33 46 163).

Moreover a stitch-length adjustment device with an electric stepping motor is provided in a further known sewing machine differing slightly from the above cited sewing machines in that the drive crank is pivotably supported on one arm of an angle-lever and the other arm of which is acted on through a rod by the electric stepping motor in order to pivot the angle-lever to adjust the drive crank pivot axis. The output crank is rotatably supported on its pivot axis and is provided with a hub from which an arm radially projects that encloses, with a fork-shaped free end, a pin at the adjacent end of a crossbeam of the feeder assembly advancing the material being sewn in order to displace this crossbeam end on a guide pin extending in the direction of advance of the material being sewn. The crossbeam rests on the other end near the feeder assembly by means of a lower projection on the cam for raising the feeder assembly. This type of sewing machine does not comprise an adjustment shaft nor an output shaft (German Offenlegungsschrift 33 21 215).

SUMMARY OF THE INVENTION

An object of the invention is to create a sewing machine of the type described above wherein the drive shaft and the output shaft can be mounted unusually near each other and the drive crank, the linkbar and the output crank may be mounted symmetrically to the same plane transverse to the drive and output shafts. It is also an object to achieve, in a simple manner, direct proportionality between the motion of the adjustment mechanism for the displaceable crank-pivot axis, on one hand, and the resulting change of the motion of the output shaft caused by the drive shaft on the other hand, and to allow such a design that permits easy changing of the transmission ratio between the drive shaft and the output shaft.

Mounting of the drive and the output shafts side by side and very close together is especially advantageous for a blind-stitching machine having an arc needle and a fabric bender to make the material being sewn bulge into the path of motion of the arc needle, since this, for instance, allows the fabric bender drive shaft to be additionally used as the drive shaft for the feeder assembly to advance the material being sewn. The symmetrical arrangement, of the drive crank, the linkbar and the output crank relative to an imaginary plane extending transverse to the drive and output shafts is very advantageous regarding the force transmission from drive shaft to output shaft and prevents the occurrence of dynamic forces. The joint implementation of the narrow mounting of the drive and output shafts and of the symmetrical arrangement of the components connecting the shafts leads to extraordinary compactness. If, upon rotation of the adjustment mechanism for the displaceable crank-pivot axis, the pivot angle of the output shaft changes according to the angle by which the adjustment mechanism has been rotated, then the stitch-length adjustment device can be simplified. The possibility of changing the transmission ratio between the drive shaft and the output shaft allows assigning maximum stitch-lengths of different magnitudes to the same pivot angle of the drive shaft and achieving the particular desired maximum stitch-length by providing the corresponding transmission ratio, the maximum stitch length being the upper limit of that range inside which the stitch-length can be changed and set.

BRIEF DESCRIPTION OF THE DRAWINGS

An embodiment of the sewing machine of the invention is illustrated in the appended drawings wherein.

DETAILED DESCRIPTION OF THE PREFERRED EMBODIMENT

Figure 1:
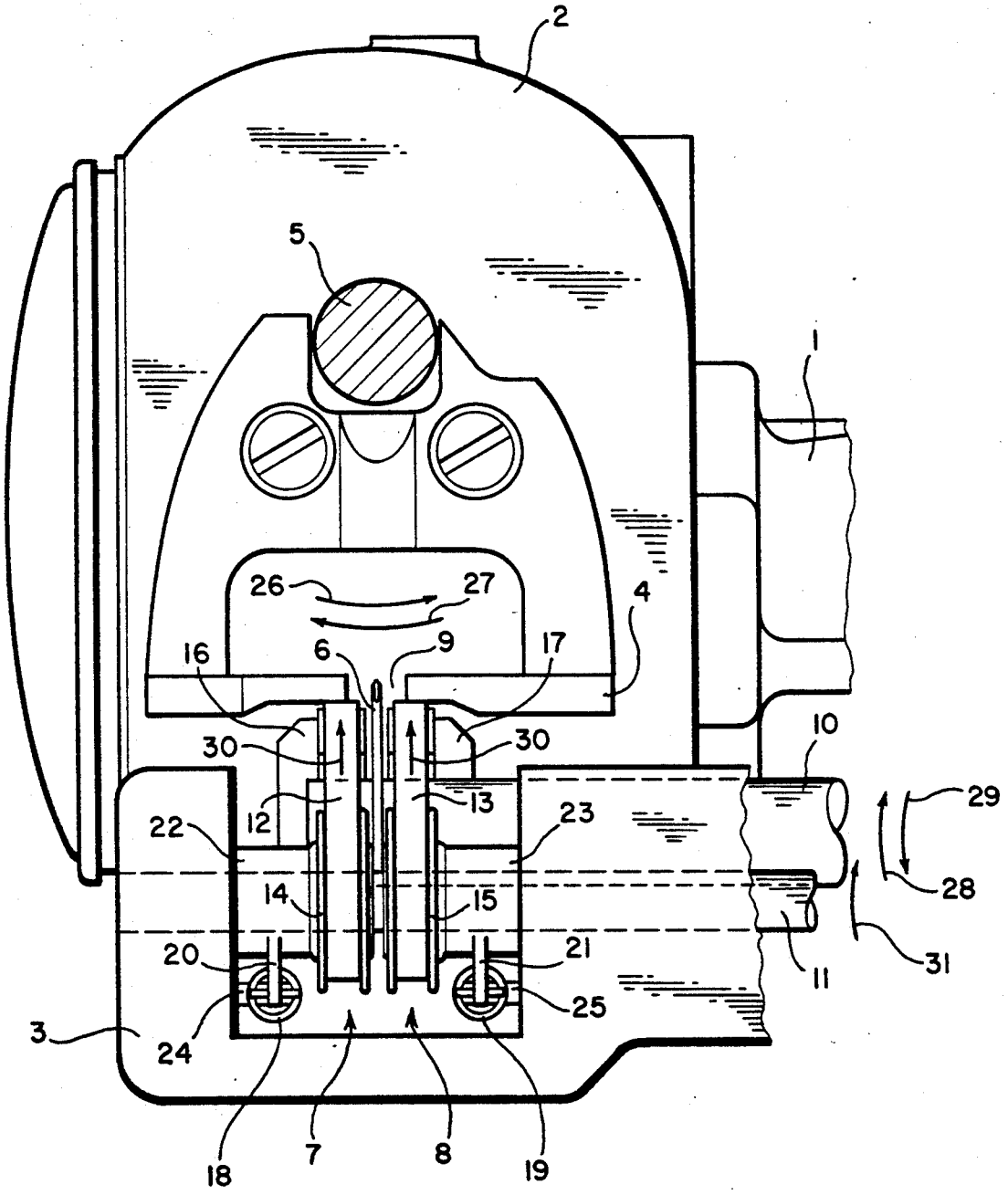
FIG. 1 is a front view of the head and of the adjacent end of the fabric support arm.
Figure 2:
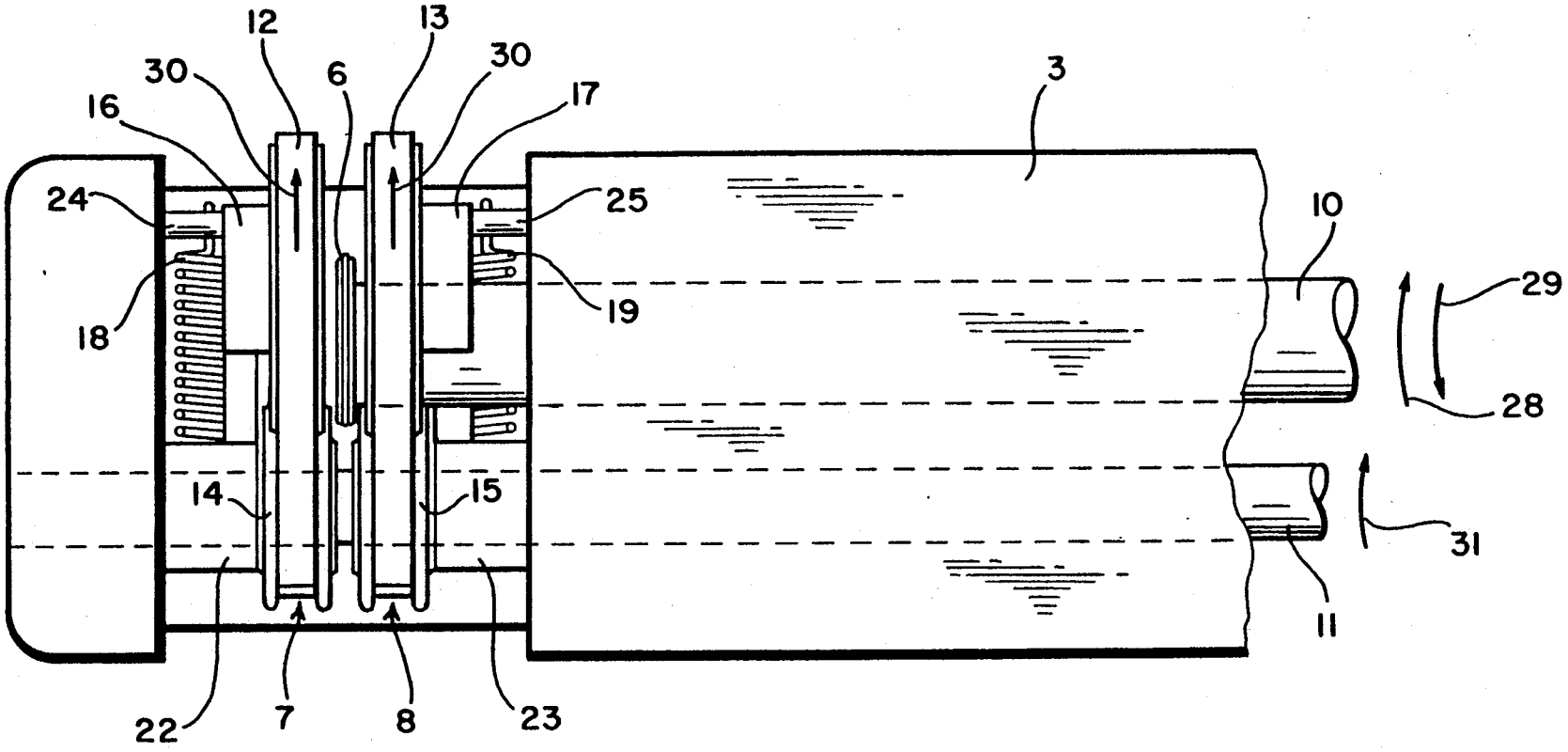
FIG. 2 is the top view of the end of the fabric support arm of FIG. 1.

The blind-stitch sewing machine in accordance with the invention as illustrated in the drawings includes an upper arm 1, a head 2 projecting forward from arm 1 and a fabric-support arm 3 which extends essentially parallel to the upper arm 1. A throat plate 4 is affixed to the head 2. Head 2 is provided with an arc needle (not shown) which moves above the throat plate 4 by means of a shaft 5 of the head 2 along an arcuate path in a to-and-fro pivoting manner, which path is concentric to the shaft 5 and tangent to the throat plate 4. The fabric support arm 3 is equipped with a fabric bender 6 and further with two sewing-material feeders 7, 8. Fabric-support arm 3 can be pivoted downward from the position shown in FIG. 1 about a horizontal axis parallel to its longitudinal axis in order to remove the fabric bender 6 and the sewing-material feeders 7, 8 from the throat plate 4, which it is required in order to place the sewing material between the throat plate 4, on one hand, and the fabric bender 6 and the sewing-material feeders 7, 8, on the other hand, and moreover to remove the sewing material.

The fabric bender 6 serves to push the sewing material through an aperture 9 in the throat plate 4 into the arc-needle's path of motion and to make the material bulge. Fabric bender 6 is plate-shaped and bender 6 extends along a plane containing the longitudinal axis of shaft 5, transverse to upper arm 1 and to fabric-support arm 3 and perpendicular to throat plate 4. Fabric bender 6 is pivotable to-and-fro in this plane by means of a shaft 10 of the fabric-support arm 3. As shown, shaft 10 extends parallel to the longitudinal axis of the fabric-support arm 3.

The two sewing-material feeders 7, 8 serve to stepwise advance the sewing material along the throat plate 4 transversely to the path of motion of the arc needle. They are mounted on each side of fabric bender 6 and are spring-loaded toward the throat plate 4 and can be intermittently moved in the sewing-material advance direction jointly by means of a further shaft 11 of the fabric-support arm 3. Shaft 11 also extends parallel to the longitudinal axis of arm 3. Each sewing-material feeder 7 and 8 consists of an endless belt 12 and 13 looping around a drive wheel 14 and 15 affixed to the shaft 11, and a guide lever 16 and 17 rotatably supported on the shaft 11 and biased by a helical tension spring 18 and 19 toward the throat plate 4, respectively. Springs 18 and 19 act on respective downwardly projecting arms 20 and 21 of hubs 22 and 23 of the guide levers 16 and 17 and, on the other hand, on arms 24 and 25 of the fabric-support arm 3.

During sewing, the arc needle swings to-and-fro as illustrated by the arrows 26, 27 of FIG. 1, while the fabric bender 6 oscillates together with its drive shaft 10 in the direction of arrows 28, 29. The two sewing-material feeders 7, 8, i.e. belts 12, 13, move stepwise in the direction of the arrows 30, with the associated shaft 11 rotating stepwise in the direction of the arrow 31. The pivoting motion of the arc needle, the oscillation of the fabric bender 6 and the displacement steps of the sewing-material feeders 7, 8 are synchronized as usual such that the arc needle, the fabric bender 6 and the sewing-material feeders 7, 8 act in the required sequence on a piece of sewing material extending between the throat plate 4 and the sewing-material feeders 7, 8.

Figure 3:
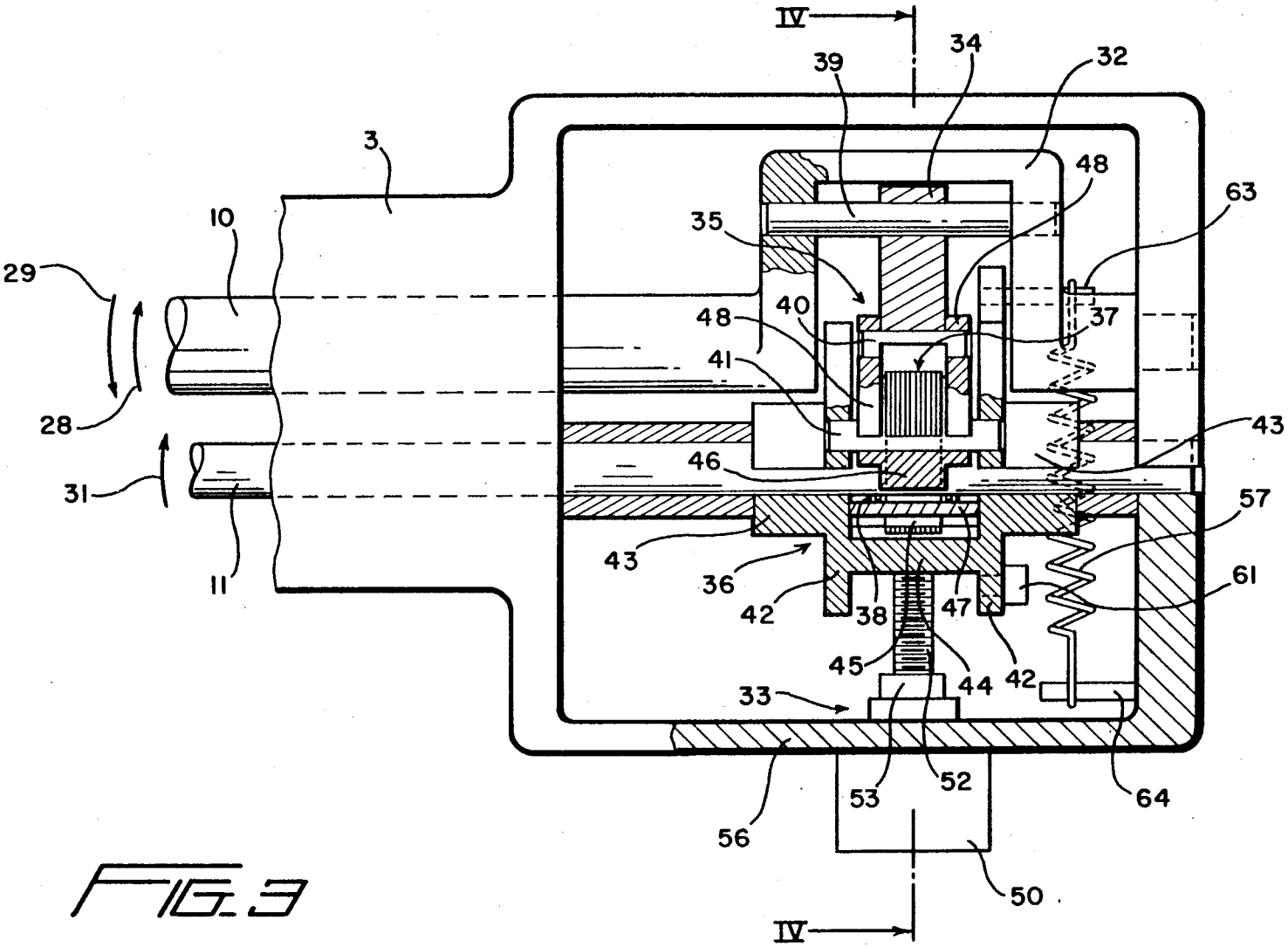
FIG. 3 is the top view of the other end of the fabric support arm shown partly sectioned along lines IIIa—IIIa, IIIb—IIIb and IIIc—IIIc of FIG. 4, the stitch-length 0 being set.

The shaft 10 is rotatably supported by fabric-support arm 3 and serves not only to drive fabric bender 6 but also to drive the two sewing-material feeders 7, 8 by means of associated shaft 11 rotatably supported by fabric-support arm 3. Drive shaft 10 is provided with a radially projecting drive crank 32 at the end remote from the fabric bender 6 which cooperates with the adjacent end of shaft 11. Shaft 11 must be driven in such manner that the angle by which shaft 11 rotates with every step in the direction of the arrow 31—and thus the length of the displacement of the sewing-material feeders 7, 8 at every step in the direction of the arrows 30 which length is identical with the stitch-length—can be changed by means of a stitch-length adjustment device 33 shown best in FIGS. 3 through 5.

The drive crank 32 is hingedly connected by a linkbar 34 to an output crank 35 pivotally supported in a sleeve 36 and cooperating through a transmission 37 and a one-way clamp clutch 38 with the output shaft 11. The sleeve 36 is rotatably supported on the output shaft 11 and adjustable by means of the stitch-length adjustment device 33. The axes 39, 40 and 41—about which the drive crank 32 and the linkbar 34, or the linkbar 34 and the output crank 35, or the output crank 35 and the sleeve 36, are mutually pivotable—extend parallel to drive shaft 10 and to output shaft 11 which are mounted tightly next to each other. The drive crank 32, the linkbar 34, the output crank 35, the sleeve 36, the transmission 37 of sleeve 36 and the one-way clamp clutch 38 are mounted symmetrically relative to the plane defined by the line IV—IV of FIG. 3 and oriented transversely to drive shaft 10 and to output shaft 11.

The drive crank 32 comprises a U-shaped yoke which encloses the sleeve 36. Sleeve 36 encloses the output crank 35 which encloses the linkbar 34. The transmission 37 is enclosed in part by the output crank 35 and, together with the one-way clamp clutch 38, in part by sleeve 36.

The linkbar 34 is pivotably supported at one end on a first bolt affixed to the drive crank 32 and at the other end on a second bolt affixed to the output crank 35. These two bolts each form pivot axes 39 and 40 respectively. The distance between the longitudinal axes of these two bolt-shaped pivot axes 39, 40 is substantially identical to the distance between the longitudinal axis of the bolt-shaped pivot axis 39 and the longitudinal axis of the drive shaft 10, so that the effective length of the linkbar 34 precisely matches that of the drive crank 32.

The sleeve 36 supporting the output crank 35 comprises two essentially circular side disks 42 each with a hub 43 and connected to each other by at least two crossbars 44 mounted diametrically opposite each other on the two sides of the output shaft 11 extending through hubs 43. A bolt rigidly joined to the two side disks 42 extends between them and forms the pivot axis 41 of the output crank 35.

Transmission 37 is in the form of a toothed-belt transmission with an endless toothed belt 45 and two toothed-belt gears 46, 47. The two toothed-belt gears 46, 47 are looped by the toothed belt 45 and are rotatably supported on the pivot axis 41 of the output crank 35 within crank 35 and respectively through the one-way clamp clutch 38 on the output shaft 11 between the two side disks 42 of the sleeve 36 supporting the output crank 35. The two crossbars 44 of sleeve 36 extend on the two sides of the toothed belt 45 and the toothed-belt gear 47 located on output shaft 11.

The output crank 35 comprises two mutually parallel legs 48 extending on either side of the linkbar 34 and the toothed-belt gear 46 associated with the output crank 35. Legs 48 are fixed to or formed integral with toothed-belt gear 46 and project radially from it. At their free ends the legs 48 are connected to each other by the bolt forming the pivot axis 40.

The one-way clamp clutch 38 provided between the output shaft 11 and the toothed-belt gear 47 mounted thereon is designed in such a way that it couples the toothed-belt gear 47 to the output shaft 11 only during the pivoting motion in the direction of the arrow 31 in order to drive shaft 11. During the pivoting motion of the toothed-belt gear 47 in the opposite direction it remains inoperative, whereby the toothed-belt gear 47 cannot drive the output shaft 11 so that it remains motionless.

The stitch-length adjustment device 33 comprises an adjustment sleeve 49 extending transverse to the output shaft 11 and acting on sleeve 36, and a manually rotatable adjustment knob 50 for axially adjusting sleeve 49 and having a threaded spindle 52 received in a threaded borehole 51 of the adjustment sleeve 49. The spindle 52 comprises a collar 53 and an unthreaded end 54 received in a borehole 55 formed in the front wall 56 of a box-shaped end of the fabric-support arm 3 which encloses the drive crank 32 of the drive shaft 10 and the adjacent end of the output shaft 11 together with the sleeve 36, the transmission 37 with the one-way clamp clutch 38, the output crank 35 and the linkbar 34. The adjustment knob 50 is mounted on that segment of the spindle end 54 which projects to the outside from the borehole 55. Knob 50 and collar 53 of the threaded spindle 52 enclose the front wall 56. Adjustment sleeve 49 is linearly shiftable along the longitudinal axis of spindle 52 by rotation of spindle 52. Adjustment sleeve 49 includes an end, remote from adjustment knob 50, that is adapted to extend into the space between the two side disks 42 and to engage a respective crossbar 44 of sleeve 36. Extension of adjustment sleeve 49 can thereby rotate sleeve 36 by engaging the crossbar 44. This rotation occurs against the tensioning force of a spring 57.

Moreover, sleeve 36 supporting output crank 35 comprises a stop 59 cooperating with a stop 58 of fabric-support arm 3. Stop 59 is in the shape of a bolt and extends transversely between the two side disks 42 of sleeve 36. The stop 58 of the fabric-support arm 3 is in the form of a threaded pin extending parallel to the threaded spindle 52 of the adjustment knob 50 of the stitch-length adjustment device 33 and is screwable into a threaded borehole 60 in the front wall 56 of fabric-support arm 3. Furthermore, a rod 61 hinges on one side disk 42 of sleeve 36 and can be actuated by a pedal (not shown) in order to rotate sleeve 36 against the action of helical tension spring 57 on the output shaft 11 until stop 59 abuts stop 58 of fabric-support arm 3.

Figure 4:
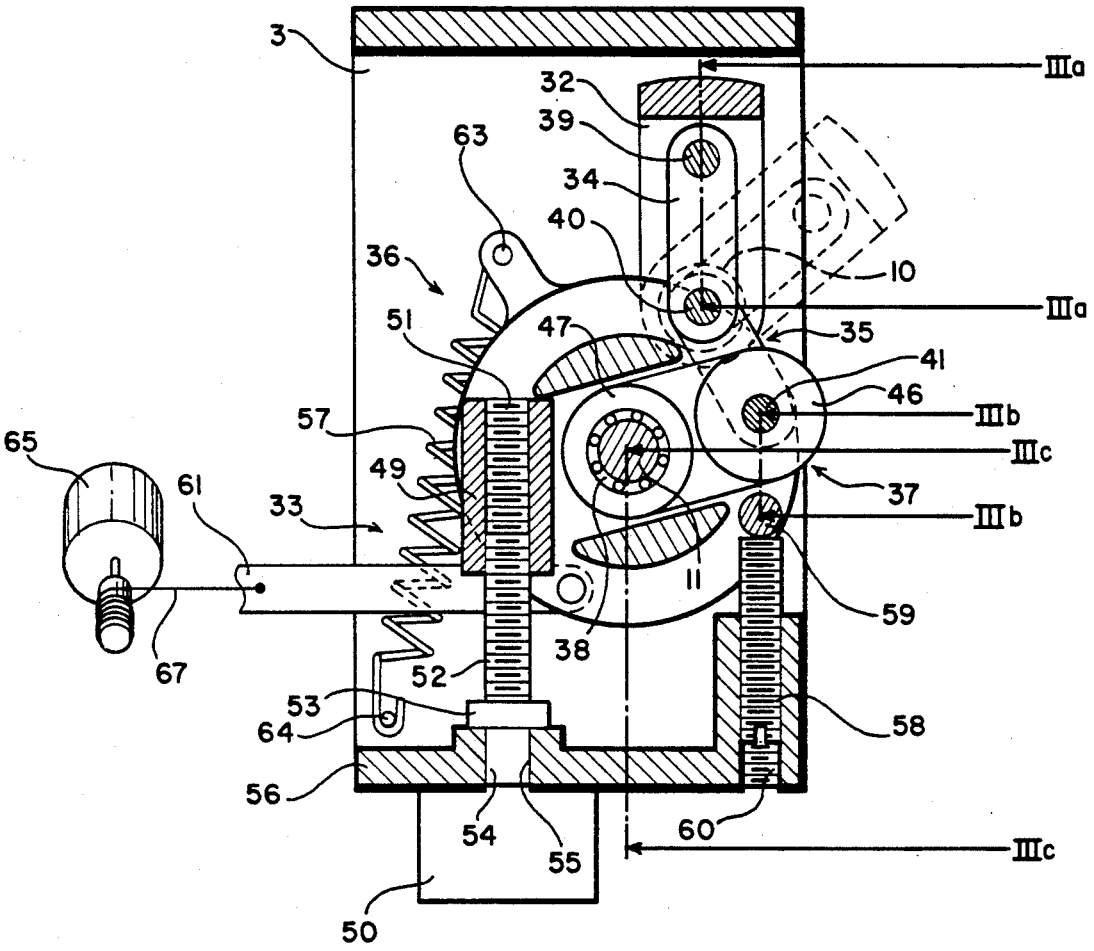
FIG. 4 is a section view along line IV—IV of FIG. 3.
Figure 5:
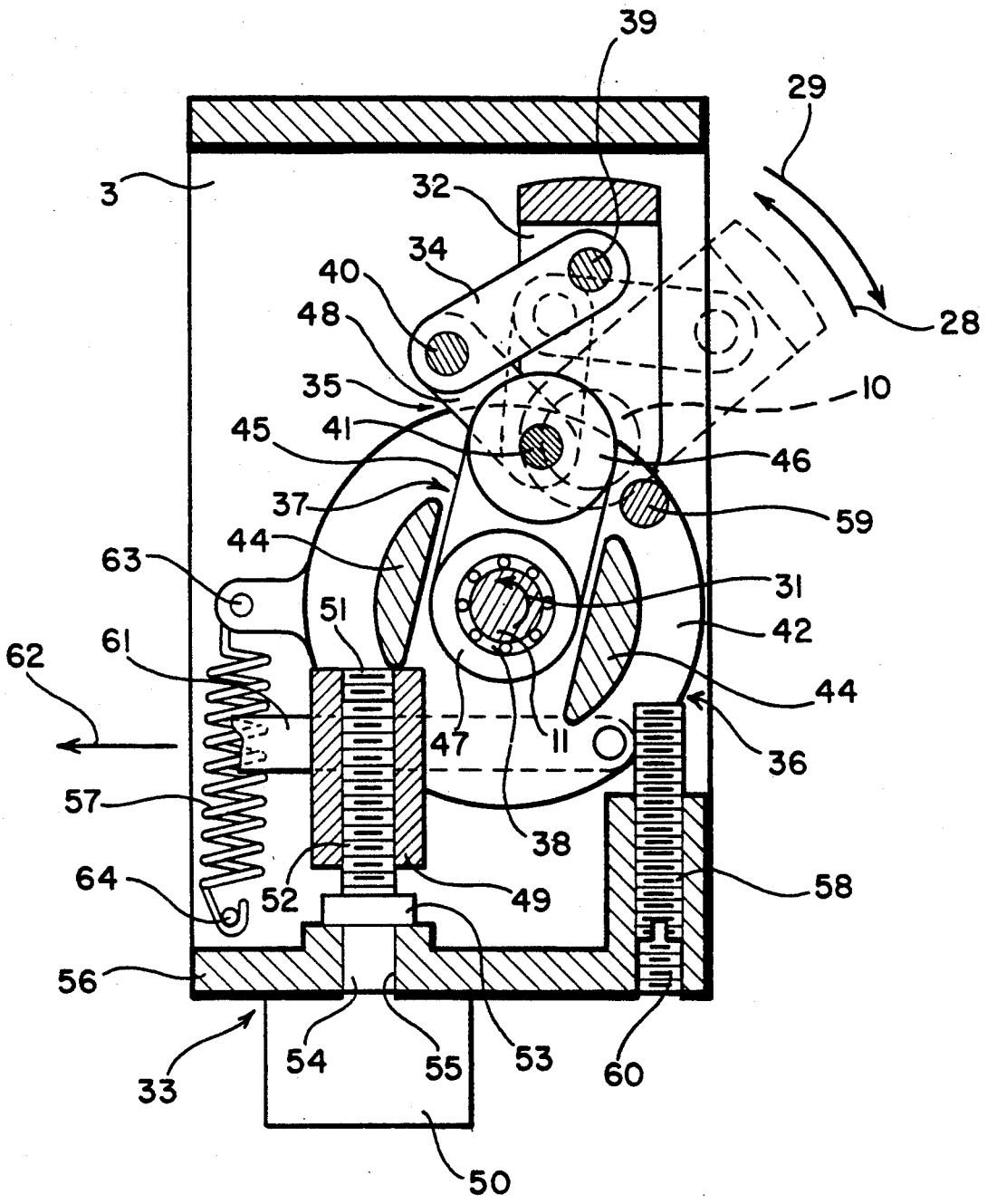
FIG. 5 is a section view corresponding to FIG. 4, with the maximum stitch length being set.

Sleeve 36 supporting output crank 35 is made continuously adjustable by means of the stitch-length adjustment device 33 between the two rotational positions on the output shaft 11 shown in FIGS. 4 and 5. This will be more fully discussed below.

In the rotational position shown by FIG. 4, the adjustment sleeve 49 of the stitch-length adjustment device 33 is located remote from its adjustment knob 50, while stop 59 of sleeve 36 abuts stop 58 of fabric-support arm 3 and pivot axis 41 of the output crank 35 is in a position such that pivot axis 40 between linkbar 34 and output crank 35 is aligned with drive shaft 10. It follows that when drive crank 32 together with the drive shaft 10 oscillates in the direction of the arrows 28, 29 between the position shown in solid lines and that shown in dashed lines, linkbar 34 also oscillates in a corresponding manner, namely on the pivot axis 40, without changing the position of axis 40 and without displacing output crank 35 which therefore is standing still. Thus, as a result, the output shaft 11 does not move, nor do the two sewing-material feeders 7, 8, i.e. belts 12, 13. Accordingly when sleeve 36 assumes the position shown in FIG. 4, the blind-stitching machine operates with a zero stitch-length.

When in the rotational position shown in FIG. 5, the adjustment sleeve 49 of the stitch-length adjustment device 33 rests agains collar 53 of its threaded spindle 52 while the stop 59 of sleeve 36 is a maximum distance away from stop 58 of fabric-support arm 3. Pivot axis 41 of output crank 35 is in a position such that when the drive crank 32 together with the drive shaft 10 oscillates in the direction of the arrows 28, 29 between the positions shown in solid and dashed lines, the output crank 35 will be pivoted to-and-fro by linkbar 34 by a maximum amount about its pivot axis 41, so that the pivot angle of the output crank 35 is a maximum. Thus, as a result, the output shaft 11 and the two sewing-material feeders 7, 8, i.e. belts 12, 13 carry out the longest steps in the direction of arrow 31 and arrows 30 respectively. Therefore, with the rotational position of sleeve 36 as shown in FIG. 5, the blind-stitching machine operates at a maximum stitch-length.

From this or any other rotational position, sleeve 36 supporting output crank 35 can be displaced by moving rod 61 in the direction of arrow 62, using the above-cited pedal, against the force of helical tension spring 57 into the rotational position of zero stitch-length as shown in FIG. 4 for the purpose of seam locking without thereby changing the stitch length as defined by the stitch-length adjustment device 33. The blind-stitching machine will continue to operate with that stitch-length when the pedal has been released, whereby sleeve 36 and rod 61 can be returned to their initial positions by means of helical tension spring 57 acting on two arms 63, 64 of sleeve 36 or of fabric-support arm 3.

The drive shaft 10, the output shaft 11 and the three pivot axes 39, 40, 41 are so arranged relative to each other that each adjustment of support sleeve 36 of the output crank 35 on the output shaft 11 entails a change of the pivot angle of the output crank 35 that is directly proportional to the angle by which sleeve 36 was rotated. Because transmission 37 operates at a 1:1 transmission ratio (such transmission ratio resulting from the two toothed-belt gears 46, 47 of the toothed-belt transmission having the same diameter), the change in that angle by which the output shaft 11 rotates with every step in the direction of arrow 31 corresponds to that adjustment angle of sleeve 36. The length of the displacement steps of the two sewing-material feeders 7, 8 in the direction 30 of sewing-material advance is altered according to this change of the angle of rotation of the output shaft 11 and to the diameter of the two drive wheels 14, 15 of the endless belts 12, 13. By changing the transmission ratio of the transmission 37, the proportionally or ratio factor between the pivot angle of the output crank 35 and the step-length of the sewing-material feeders 7, 8 may be changed, whereby any desired maximum stitch-length can be achieved in simple manner for one and the same pivot angle of the drive shaft 10 and of the drive crank 32. In order to change the transmission ratio of the transmission 37, it suffices to exchange the transmission components, namely to substitute the toothed-belt gears 46, 47 of the toothed-belt transmission 37 by toothed-belt gears of correspondingly different diameters, a step which inherently requires providing a matching toothed belt 45.

It should be noted that various changes can be made to the above described embodiment without departing from the spirit of the invention. For instance, in addition to, or in lieu of adjustment sleeve 49 and the adjustment knob 50 cooperating through the threaded spindle 52, the stitch-adjustment device 33 may comprise an electric stepping motor to adjust support sleeve 36 of output crank 35 in accordance with a desired stitch-length set in a stepping motor control circuit through an operating panel. For example, a conventional type of stepping motor, generally indicated at 65 in FIG. 4, having a rotatable drum 66 about which a flexible cable 67, attached to rod 61, is wound could be used. Also, the threaded pin forming stop 58 of fabric-support arm 3 may be provided with an adjustment knob similar to the adjustment knob 50 of threaded spindle 52 in order to permit the threaded pin to be screwed into the associated threaded borehole 60, whereby the rotational position of sleeve 36 as shown in FIG. 4 is assured. However, stop 58 also may be brought into a different position in order to achieve a very short stitch length in lieu of the zero stitch-length for purposes of seam locking.

The two bolt-shaped pivot axes 39, 40 between each crank 32, 35 respectively and linkbar 34 also may be rigidly joined to the linkbar and be rotatably supported in drive crank 32 and output crank 35 respectively. It is equally feasible to rigidly join the bolt-shaped pivot axis 41 of output crank 35 to the associated toothed-belt gear 46 of the toothed-belt transmission 37 and to rotatably support the axis in the output-crank supporting sleeve 36. Similarly the other toothed-belt gear 47 of the toothed-belt transmission may be affixed to output shaft 11, while the output crank 35 and the associated toothed-belt gear 46 are separated and the one-way clamp clutch 38 is mounted between these two components. For instance, a bush may be provided which interconnects the two legs 48 of the output crank 35 and through which the bolt-shaped pivot axis 41 of output crank 35 extends, and the one-way clamp clutch 38 may be mounted between the bush and the toothed-belt gear 46; or pivot axis 41 may be affixed to legs 48 and rotatably supported in sleeve 36 and one-way clamp clutch 38 may be mounted between pivot axis 41 and toothed-belt gear 46. The toothed-belt gear 47 associated with output shaft 11 also may be affixed to output shaft 11 and a one-way clamp clutch 38 may be provided between output shaft 11 and each drive wheel 14 and 15 for the endless belt 12 and 13 of the sewing-material feeder 7 and 8 respectively. The transmission 37 does not necessarily need to be a toothed-belt transmission and other steps may be employed to change the transmission ratio than exchanging the transmission components, i.e., the toothed-belt gears 46, 47 and the toothed-belt 45 of the toothed-belt transmission. For example, a continuously adjustable transmission can be provided instead. Specifically, the toothed-belt 45 can be substituted by a V-belt and the two toothed-belt gears 46, 47 can each comprise a pair of mutually adjustable disks of a V-belt pulley.

Moreover, output shaft 11 may cooperate with one or more sewing-material feeders in the form of a wheel or roller or of the type that is displaceable up-and-down as well as to-and-fro in order to move the feeder or feeders of this type to-and-fro in the direction of advance 30 of the material and in the opposite direction respectively. In the latter case, the one-way clamp clutch 38 would be omitted and further steps would be taken in order to raise and lower the sewing-material feeder(s) vertically. Also, it is possible to let the output shaft 11 cooperate additionally with one or more upper sewing-material feeders. If several sewing-material feeders are driven by output shaft 11, steps may be taken to achieve differential advancing of the sewing material.

Lastly, the invention may be kinematically reversed in that the support sleeve of the output crank rather than the drive crank can be used as drive member and the last mentioned crank, instead of the support sleeve can be adjusted for the stitch-length setting. In general, the above description is only of a preferred embodiment and numerous changes and/or variations may be evident to one of ordinary skill in the art without departing from the spirit of the invention. Therefore, the invention is only intended to be limited by the scope of the following claims.

I claim:

1. A sewing machine having a sewing area and feeder means for advancing material being sewn through said sewing area in a stepwise manner, said sewing machine comprising:

A. means for moving said feeder means intermittently in the direction in which said material being sewn is advanced, said moving means including:

a drive shaft pivotable to-and-fro and provided with a radially projecting drive crank;

an output shaft extending parallel to said drive shaft and drivingly connected to said feeder means;

an output crank pivotable about an axis parallel to said output shaft;

a linkbar interconnecting said drive crank and said output crank at two pivot axes parallel to said output crank pivot axis, said linkbar having an effective length equal to the effective length of the drive crank; and means for transmitting motion of said output crank to said output shaft; and B. means for adjusting the stitch-length of said sewing machine, said stitch-length adjusting means including:

means for supporting said output crank pivotably, said supporting means being rotatably supported on said output shaft and being provided with said motion transmitting means; and means for rotating said supporting means on said output shaft, whereby said output crank pivot axis is displaced with respect to said drive shaft to set the length of each motion of said feeder means and hence the stitch-length of said sewing machine.

2. A sewing machine as claimed in claim 1, wherein said drive crank is in the shape of a yoke extending across said linkbar, said output crank and said supporting means.

3. A sewing machine as claimed in claim 1, wherein said output crank comprises two mutually parallel legs extending on either side of said linkbar and said motion transmitting means.

4. A sewing machine as claimed in claim 1, wherein said supporting means comprises two substantially circular disks extending on either side of said output crank and said motion transmitting means.

5. A sewing machine as claimed in claim 1, wherein said motion transmitting means comprises a toothed-belt transmission with two toothed-belt gears looped by an endless toothed belt, one of said gears being mounted on said output crank pivot axis and the other gear being mounted on said output shaft.

6. A sewing machine as claimed in claim 1, wherein the transmission ratio of said motion transmitting means is variable.

7. A sewing machine as claimed in claim 6, wherein said motion transmitting means includes elements which are exchangeable to vary the transmission ratio.

8. A sewing machine as claimed in claim 1, wherein a one-way clamp clutch is arranged between said output crank and said feeder means.

9. A sewing machine as claimed in claim 1, wherein said feeder means comprises an endless belt and a one-way clamp clutch is arranged between said output crank and said endless belt.

10. A sewing machine as claimed in claim 1, wherein said means for rotating said supporting means comprises an adjustment sleeve extending transversely to said output shaft and acting on said supporting means and a manually rotatable adjustment knob having a threaded spindle screwable into a threaded borehole of said adjustment sleeve to axially displace said adjustment sleeve.

11. A sewing machine as claimed in claim 1, wherein said stitch-length adjusting means comprises an electric stepping motor for rotating said supporting means on said output shaft into a position wherein said output crank pivot axis is located relative to said drive shaft so as to correspond to the desired stitch-length.

12. A sewing machine as claimed in claim 1, wherein said supporting means can be rotated against the force of a spring from a rotational position on said output shaft as determined by said rotating means, toward a stop, into a position corresponding to a substantially zero stitch-length for purposes of seam locking.

13. A sewing machine as claimed in claim 1, wherein said output shaft is drivingly connected to a plurality of feeder means.

14. A sewing machine as claimed in claim 1, further comprising at least one fabric bender oscillated by said drive shaft and being adapted to cooperate with an arc needle for blind stitching said material being sewn.

* * * * *